US007507140B2

(12) United States Patent
Yamaguchi

(10) Patent No.: US 7,507,140 B2
(45) Date of Patent: Mar. 24, 2009

(54) PLAY FACILITY FOR REMOTE-CONTROL SYSTEM

(75) Inventor: Takashi Yamaguchi, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 752 days.

(21) Appl. No.: 10/513,877

(22) PCT Filed: May 8, 2003

(86) PCT No.: PCT/JP03/05788

§ 371 (c)(1),
(2), (4) Date: Dec. 14, 2004

(87) PCT Pub. No.: WO03/095054

PCT Pub. Date: Nov. 20, 2003

(65) Prior Publication Data

US 2005/0186883 A1 Aug. 25, 2005

(30) Foreign Application Priority Data

May 8, 2002 (JP) ..... 2002-133396

(51) Int. Cl.
*A63H 30/00* (2006.01)

(52) U.S. Cl. ..... 446/454; 340/825.72

(58) Field of Classification Search ..... 446/454–456; 463/58–60, 6–7; 340/825.69, 825.72; 318/16
See application file for complete search history.

(56) References Cited

U.S. PATENT DOCUMENTS 3,587,100 A * 6/1971 Doremus et al. ..... 463/6

FOREIGN PATENT DOCUMENTS

| | | | |
|---|---|---|---|
| CA | 2475789 | | 10/2004 |
| JP | 62-20059 | A | 5/1987 |
| JP | 6-63250 | A | 3/1994 |
| JP | 30441061 | U | 9/1997 |
| JP | 2713603 | B2 | 10/1997 |
| JP | 10-211366 | A | 8/1998 |
| JP | 10211366 | A * | 8/1998 |
| JP | 11-90051 | A | 4/1999 |
| JP | 2000-288244 | A | 10/2000 |

* cited by examiner

*Primary Examiner*—Dmitry Suhol
*Assistant Examiner*—Alex F R P Rada, II
(74) *Attorney, Agent, or Firm*—Darby & Darby P.C.

(57) ABSTRACT

A play facility for a remote-control system including a transmitter 2 and a drive device 1 remote-controlled by drive data transmitted by the transmitter. The play facility includes a scramble signal generating device 106 which generates scramble signals to interfere with the remote control of the drive device by the transmitter, a scramble signal outputting device 55 which outputs the scramble signals to the play field, and a scramble signal control devices 100, 104 which switches between output and termination of the scramble signals from the scramble signal outputting device according to predetermined conditions.

9 Claims, 12 Drawing Sheets

PLAY FACILITY FOR REMOTE-CONTROL SYSTEM

CROSS-REFERENCE TO PRIOR APPLICATION

This is a U.S. national phase application under 35 U.S.C. §371 of International Patent Application No. PCT/JP03/05788 filed May 8, 2003, and claims the benefit of Japanese Patent Application No. 2002-133396 filed May 8, 2002 which is incorporated by reference herein. The International Application was published in Japanese on Nov. 4, 2003 as WO 03/095054 A1 under PCT Article 21(2).

TECHNICAL FIELD OF THE INVENTION

The present invention relates to a play facility in which a player can enjoy a remote-control system.

BACKGROUND OF THE INVENTION

In a toy which can be driven by remote control and personalized (hereinafter referred to as "personal use remote-control toy"), a player has enjoyed the personal use remote-control toy in the closed world such that the player has used a portion in a house or out of doors to play a race or the like with player's friends or acquaintances.

Therefore, the players often enjoy the personal use remote-control toy with the same partners in the same place, and the player is likely to be satiated with the personal use remote-control toy in the end. The so-called power player who has acquired operation skill to a certain level has no place where to exhibit the skill more than the certain level, so that it is also difficult to keep the power player's interest.

However, even if large-scale facilities are prepared in order to attract interest of the player, since the personal use remote-control toy is configured for the personal use, the personal use remote-control toy has a problem that output is weak and the personal use remote-control toy can not correspond to the large-scale facilities. When anyone can utilize the large-scale facilities by bringing on the device owned by a person, there is also generated the problem that management on the play facility side providing the field where the personal use remote-control toy can be operated can not become economically viable.

SUMMARY OF THE INVENTION

In view of the foregoing, it is an object of the invention to provide a play facility in which permission and prohibition of the use can be controlled according to predetermined conditions, in order that the personal use remote-control toy can be operated in large scale facilities away from day-to-day life, acquired play skills can be exhibited on the commercial facility, and profits can be expected by the person who provides the play field.

The invention solves the problems by a play facility for a remote-control system to provide a play field for the remote-control system including a transmitter and a drive device remote-controlled by drive data transmitted from the transmitter. The play facility includes a scramble signal generating device which generates scramble signals to interfere with the remote control of the drive device by the transmitter; a scramble signal outputting device which outputs the scramble signals to the play field; and a scramble signal control device which switches between output and termination of the scramble signals from the scramble signal outputting device according to predetermined conditions.

This enables the provision of the play facility in which the permission and the prohibition for the utilization of the play field configured to correspond with the remote-control system can be switched according to the predetermined conditions.

According to one embodiment of the present invention, it is also possible that the scramble signal control device determines whether the predetermined conditions are satisfied, and the scramble signal control device terminates the output of the scramble signals when it is determined that the predetermined conditions are satisfied.

This enables the provision of the play facility in which permits only the player who satisfies the predetermined conditions to utilize the play field when the predetermined conditions are previously set.

In another embodiment of the present invention, it is also possible to include a drive data relay device which inputs the drive data output from the transmitter, determines whether the predetermined conditions are satisfied, and outputs the drive data toward the play filed when it is determined that the predetermined condition is satisfied.

Therefore, even if the output of the transmitter is weak and the output drive data does not reach the whole play field, the drive data can be amplified and output to the play field, and the player can perform the remote control independently of the size of the play field.

In another embodiment of the present invention, it is also possible that the scramble signal control device has an output switching device which selectively switches between relay of the drive data with the drive data relay device and output of the scramble signals toward the play field according to the predetermined condition.

Therefore, the scramble signals are output when the use of the play field is prohibited, and the drive data is output when the use of the play field is permitted. Since either the scramble signal or the drive data is selectively output, the switching control is effectively performed by the play facility.

In still another embodiment of the present invention, it is also possible that the remote-control system is the system where a plurality of drive devices provided by the drive device is remote-controlled individually by each of a plurality of transmitters, each prepared corresponding to each of the drive devices, the drive data transmitted by each of the plurality of transmitters includes identification information, which is unique to each transmitter for identifying itself, and control information for controlling the drive device, and each of the plurality of drive devices compares the identification information included in the received drive data with identification information allocated to itself to determine whether the received drive data is the drive data transmitted to itself, and performs operation control based on the drive data when it is determined that the received drive data is the drive data transmitted to itself.

Therefore, the remote-control system, in which the plurality of drive devices one-to-one corresponds to the plurality of transmitters and the plurality of drive devices can be individually remote-controlled at the same time, can be applied to the play facility of the invention.

In another embodiment of the present invention, it is also possible that that the scramble signal generating device generates the scramble signals for interfering with the remote control by the transmitter to which a particular identification information is allocated.

Therefore, in the remote-control system in which the plurality of drive devices one-to-one corresponds to the plurality of transmitters and the plurality of drive devices can be individually remote-controlled at the same time, it is possible to interfere with the remote control of the drive device which is driven by the particular transmitter and corresponds to the transmitter.

In still another embodiment of the present invention, it is also possible that each of the plurality of transmitters comprises a device which receives the drive data transmitted from other transmitters, a transmission timing device which sets transmission timing of the own drive data based on the identification information included in the received drive data, and transmits the drive data according to the set transmission timing, and a suspending device which detemrines whether the identification information included in the drive data transmitted from other transmitters is identical to the identification information set in itself, and suspends the setting of the transmission timing by the timing setting device until the drive data including the identification information different from the own identification information is received when the identification information included in the drive data transmitted from other transmitters is identical to the identification information set in itself, wherein the scramble signals includes the identification information.

The signal including the identification information of the transmitter which is the subject of the interference can be used as the scramble signal, since the transmitter which receives the drive data including the own identification information utilizes the timing setting device which suspends the transmission of the own drive data.

In still another embodiment of the present invention, it is possible that the scramble signal control device terminates the output of the scramble signals within a range according to dropped value.

Therefore, the player who has dropped the predetermined value is permitted to use the play field of the present invention. For example, a coin, a medal, a token, a pre-paid card, and electronic money are thought as the value applied to the present invention, and the present invention can contribute to profits of a play facility provider.

One embodiment of the invention can solve the problems by a play facility for a remote-control system by providing a play field for a remote-control system including a transmitter and a drive device remote-controlled by drive data transmitted from the transmitter. The play facility includes a drive data inputting device which inputs the drive data output from the transmitter; a drive data outputting device which outputs the drive data toward the play field; and a drive data relay device which relays the drive data input by the drive data inputting device to the drive data outputting device, when predetermined conditions are satisfied.

Therefore, whether the drive data output from the transmitter is relayed to output the drive data to the play field can correspond to the permission and the prohibition of the use of the play field. That is, when the predetermined condition is satisfied, the relay is performed to enable the provision of the play facility in which the use of the play field is permitted.

It is also possible that the remote-control system is a system where each of a plurality of drive devices provided by the drive device is remote-controlled individually by each of a plurality of transmitters, each prepared corresponding to each of the drive devices, the drive data transmitted by each of the plurality of transmitters includes identification information, which is unique to each transmitter for identifying itself, and control information for controlling the drive device, and each of the plurality of drive devices compares the identification information included in the received drive data with identification information allocated to itself to determine whether the received drive data is the drive data transmitted to itself, and performs operation control based on the drive data when it is determined that the received drive data is the drive data transmitted to itself.

Therefore, one embodiment of the invention can be applied to the remote-control system, in which the plurality of drive devices correspond one-to-one to the plurality of transmitters and the plurality of drive devices can be individually remote-controlled at the same time.

It is also possible that the drive data relay device relays the drive data having a particular identification information to the drive data outputting device.

Therefore, in the remote-control system in which the plurality of drive devices correspond one-to-one to the plurality of transmitters and the plurality of drive devices can be individually remote-controlled at the same time, it is possible to permit only the use of the particular transmitter satisfying the predetermined condition and the drive device corresponding to the particular transmitter.

It is also possible that the drive data relay device relays the drive data within a range according to dropped value. Therefore, only the player who has dropped the predetermined value is permitted to use the play field of the present invention.

In another embodiment of the present invention, it is possible that, when a predetermined race is held by the plurality of drive devices in the play field, the drive device has a transmission source which sends the identification information allocated to itself, the play field has at least one reception terminal which receives contents of the sending at at least one predetermined place, and the remote-control system has a race management device which determines whether each of the drive devices participating in the race passes through the predetermined places based on the data received by the reception terminals, and manages the data concerning wins and losses of the race. Therefore, the car race can be performed by the remote control.

It is also possible that the race management device returns a refund of the value according to the result in the race. Therefore, player's interest and aspiration for the car race can be enhanced.

BEST MODE FOR CARRYING OUT THE INVENTION

Figure 1:
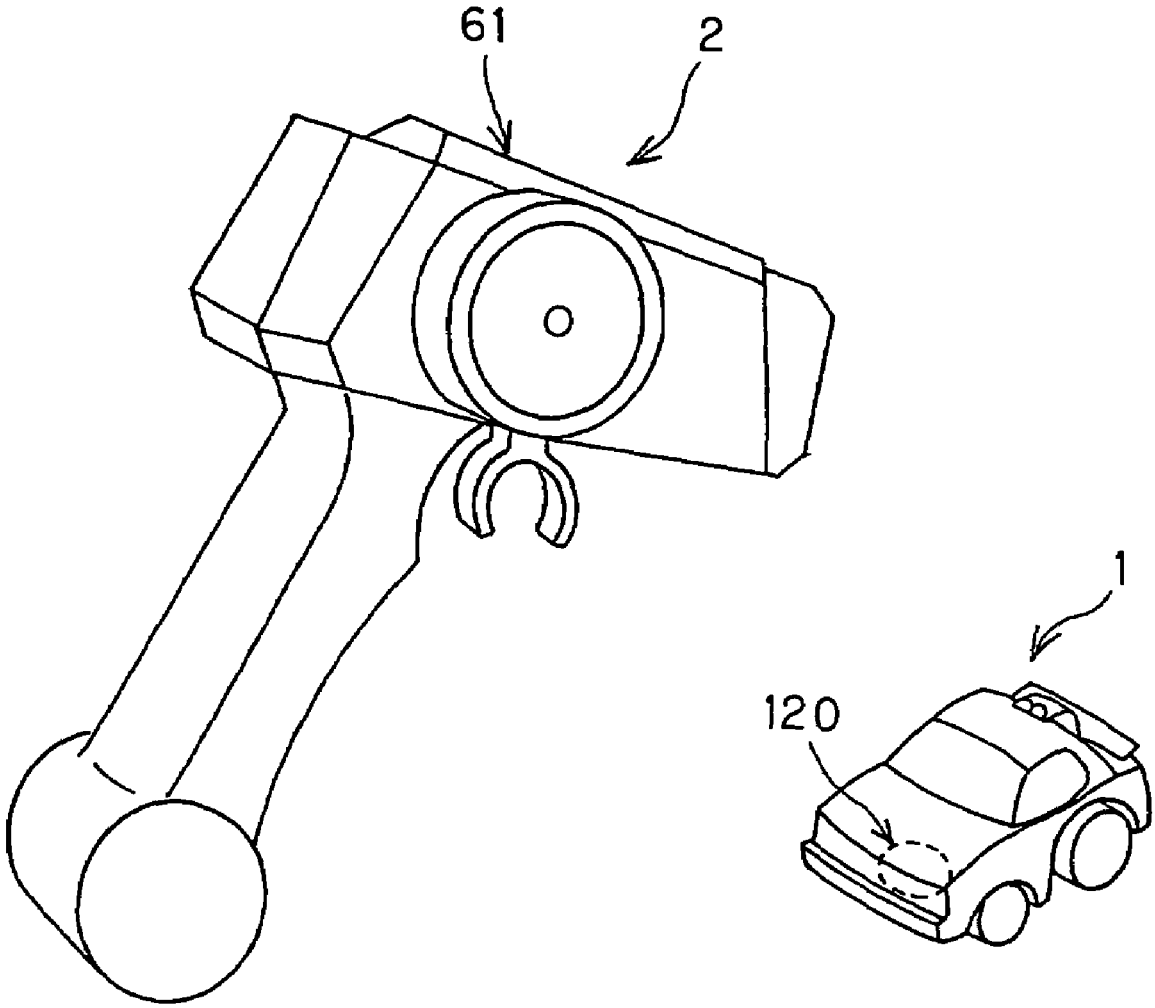
FIG. 1 shows an example of a configuration of a remote-control system in the present invention.
Figure 2A:
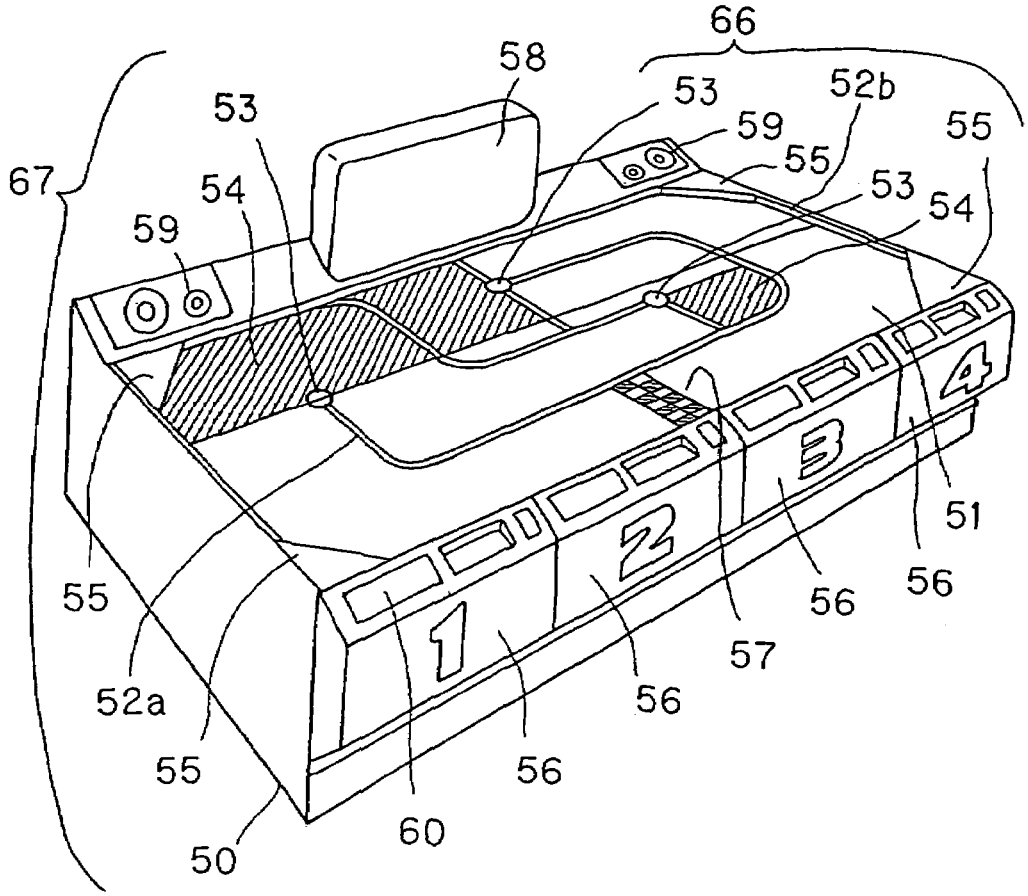
FIG. 2A shows an example of the configuration of a play facility in which a car race can takes place by the remote-control system shown in FIG. 1.

FIGS. 1 and 2A show an embodiment of the present invention. FIG. 1 is an example of a configuration of the remote-control system in the present invention. A drive device 1 is configured to be an automobile model, and the drive device 1 is driven by drive data output from a transmitter 2. FIG. 2A shows an example of the configuration of a play facility 67 in which a car race can take place by the remote-control system.

A concrete flow until the start of the game utilizing the play facility 67 is as follows:

Scramble signals are output from boosters 55 . . . 55 in an overall circuit 66 until a predetermined amount of medals are dropped. Therefore, a player can not remote-control the drive device 1 in the circuit 66 until the player drops the predetermined amount of medals. In a station 56 corresponding to the identification number of the player's drive device 1, the player drops the number of medals required for race entry from a medal input port 65 to connect the not connected side of a code 64 with a transmitter output unit 61 in the transmitter 2 owned by the player. After the predetermined amount of medals are dropped, the scramble signals output from the boosters 55 . . . 55 are terminated to output if the other player dose not operate the drive device 1 having the same identification information as the player. Therefore, the player can start to play the game by the remote control. Then, the boosters 55 . . . 55 output drive data from the transmitter 2 instead of the scramble signals, which allows the player to remote-control the drive device 1 in a circuit course 51.

The drive device 1, the transmitter 2, and the play facility 67 will be sequentially described in detail below.

Figure 6:
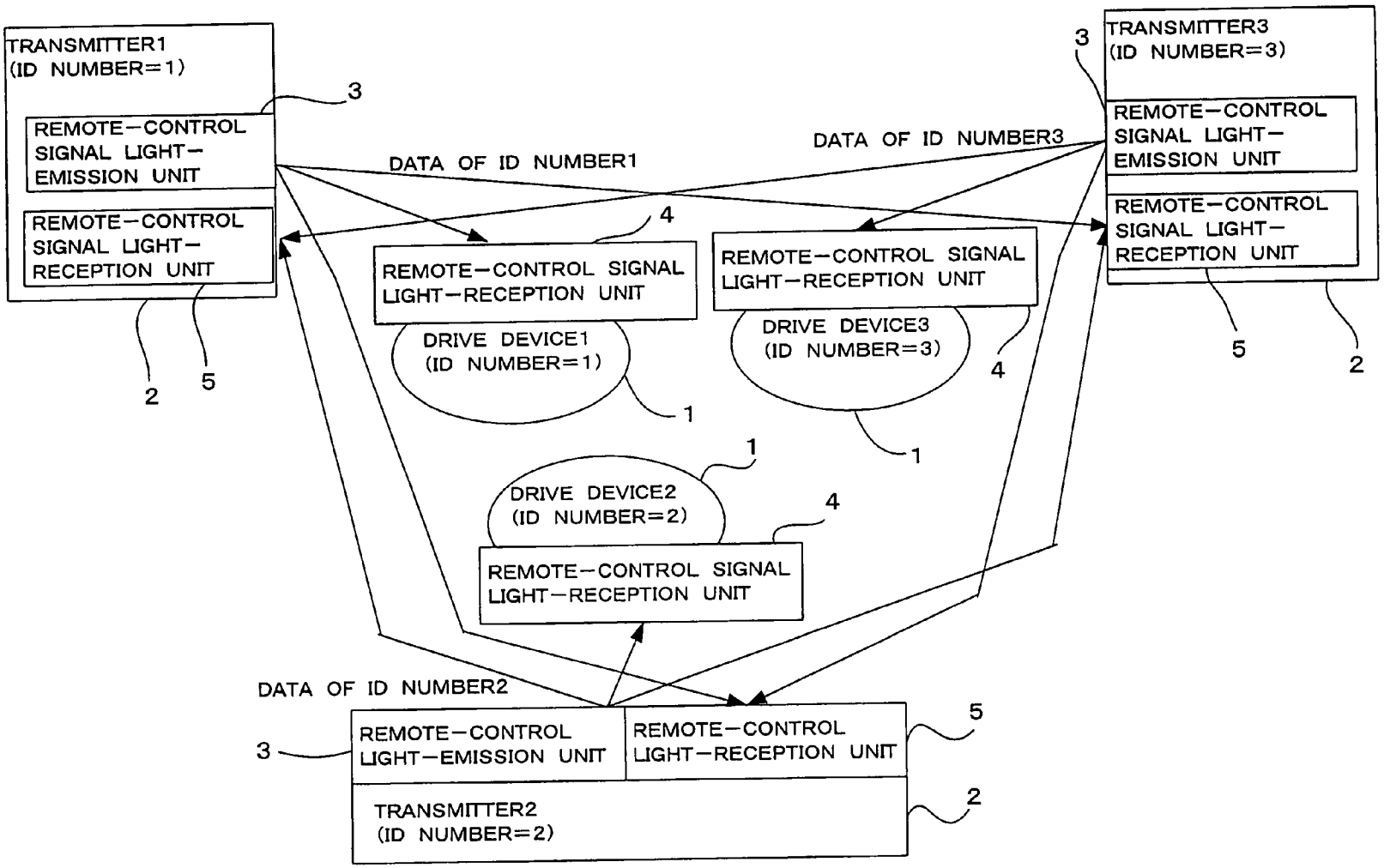
FIG. 6 shows a schematic configuration of the remote-control system of FIG. 1.

FIG. 6 shows a schematic configuration of the remote-control system in the present invention. In FIG. 6, it is assumed that three drive devices 1 . . . 1 are remote-controlled in the same place.

The transmitters 2 . . . 2 are prepared in one-to-one correspondence for each drive device 1. The numbers 1 to 3 are set as identification numbers for the drive devices 1 . . . 1 and the transmitter 2. The drive device 1 and the transmitter 2 which are designated by the same identification number are paired. Each drive device 1 is remote-controlled based on the drive data from the transmitter designated by the same identification number. An electromagnetic wave such as infrared and radio wave is utilized for the remote-control of each drive device 1. Therefore, a remote-control signal light-emission unit 3 is mounted on each transmitter 2 and a remote-control signal light-reception unit 4 is mounted on each drive device 1. Further, in order to provide synchronization of data transmission from each transmitter 2, a remote-control signal light-reception unit 5 is mounted on each transmitter 2.

Figure 7:
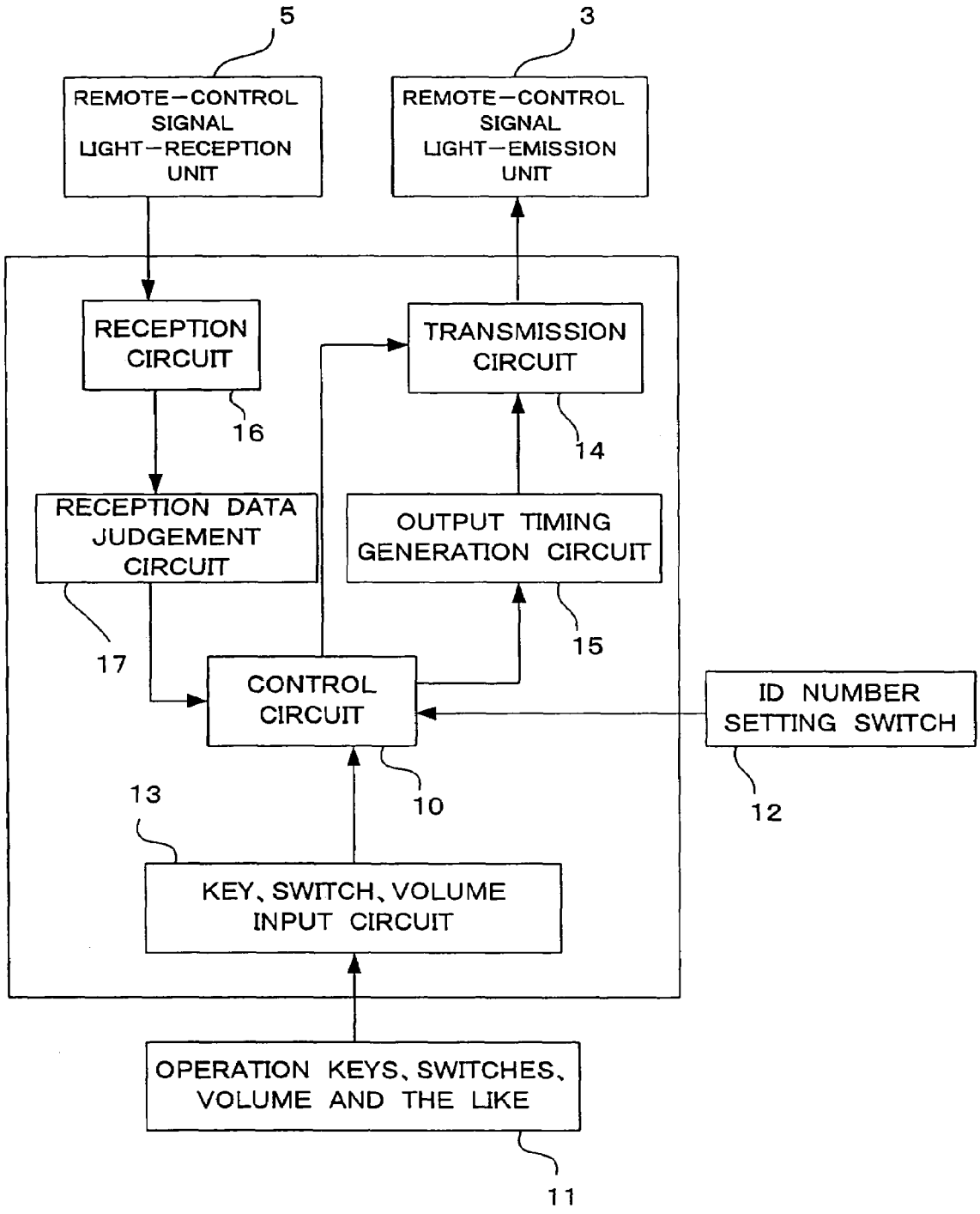
FIG. 7 shows a circuit configuration of a transmitter of FIG. 1.

FIG. 7 shows a circuit configuration of the transmitter 2. While the remote-control signal light-emission unit 3 and the remote-control signal light-reception unit 5 are provided in the transmitter 2, a control circuit 10 which generates the drive data to be transmitted and controls other circuits, an input device 11 such as an operation key, a switch, and a volume control for controlling the operation of the drive device 1, and a switch 12 for setting the identification number are provided in the transmitter 2. An input circuit 13 detects an operation state of the input device 11 by an operator, and operation signals according to the operation state of the input device 11 are input from the input circuit 13 to the control circuit 10. The identification number set by an identification number setting switch 12 is read by the control circuit 10. By the identification number setting switch 12, it is also possible that an arbitrary identification number is selected from a predetermined range determined by the operator or a system manager, or it is also possible that the identification number is previously fixed to the specified number by a manufacturer of the transmitter 2.

The remote-control signal light-emission unit 3 is configured to include light emitting means such as LED, and emits infrared or the like according to direction from a transmission circuit 14. The transmission circuit 14 outputs transmit data to the remote-control signal light-emission unit 3 according to a timing directed from an output timing generation circuit 15. The data output to the remote-control signal light-emission unit 3 is generated in the control circuit 10. The transmission circuit 14 performs modulation with remote-control signal carrier signals to the data generated in the control circuit 10 to drive the remote-control signal light-emission unit 3. The output timing generation circuit 15 counts the time according to a timer setting value given from the control circuit 10. When the time corresponding to the timer setting value has elapsed, the output timing generation circuit 15 outputs a transmission direction to the transmission circuit 14. Note that frequencies of the carrier signals output from the remote-control signal light-emission units 3 are identical in all the transmitters 2 in this embodiment, but it is possible to the frequency as the identification information of the transmitter 2 by changing the frequency depending on the transmitter 2.

Figure 8:
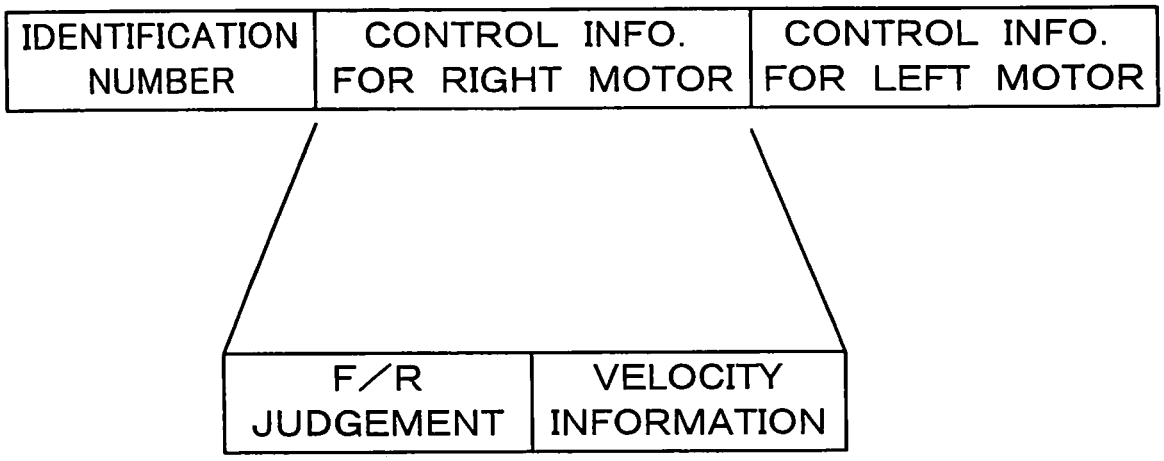
FIG. 8 shows one block of drive data transmitted from the transmitter of FIG. 1.

The remote-control signal light-reception unit 5 receives the infrared or the like transmitted from another transmitter 2 and outputs the signals, in which a carrier component is removed from the received infrared or the like, to a reception circuit 16. The reception circuit 16 decodes the signals given from the remote-control signal light-reception unit 5 into the drive data of one block to output the drive data to a reception data judgement circuit 17. In this case, as shown in FIG. 8, the drive data of one block is configured by the identification number and control information for a pair of motors provided on the left and right sides in the drive device 1. The number of bits in the drive data of one block is always constant. Therefore, the time required for the transmission of the drive data of one block is also constant.

The reception data judgement circuit 17 judges the identification number of the reception data given from the reception circuit 16 to give the judgement result to the control circuit 10. The control circuit 10 controls the operations of the transmission circuit 14 and the output timing generation circuit 15 based on the information given from the reception data judgement circuit 17, the identification number setting switch 12, and the input circuit 13. The control circuit 10 judges whether radio interference occurs and sets the timing for outputting the transmit data of itself based on the identification number of the received data given from the reception data juegement circuit 17 and the own identification number set by the identification number setting switch 12. Then, the control circuit 10 sets the timer setting value for the output timing generation circuit 15 according to the set output timing. Further, the control circuit 10 generates the drive data for the drive device 1 having the same identification number as the own number based on the information given from the identification number setting switch 12 and the input circuit 13, and the control circuit 10 outputs the drive data to the transmission circuit 14.

Each of the transmission circuit 14, the output timing generation circuit 15, the reception circuit 16, and the reception data judgement circuit 17 can be configured as a logic circuit or configured by combining a microcomputer and a predetermined program as the control circuit 10. It is possible that at least one of the output timing generation circuit 15 and the reception data judgement circuit 17 is integrated with the control circuit 10.

Figure 9:
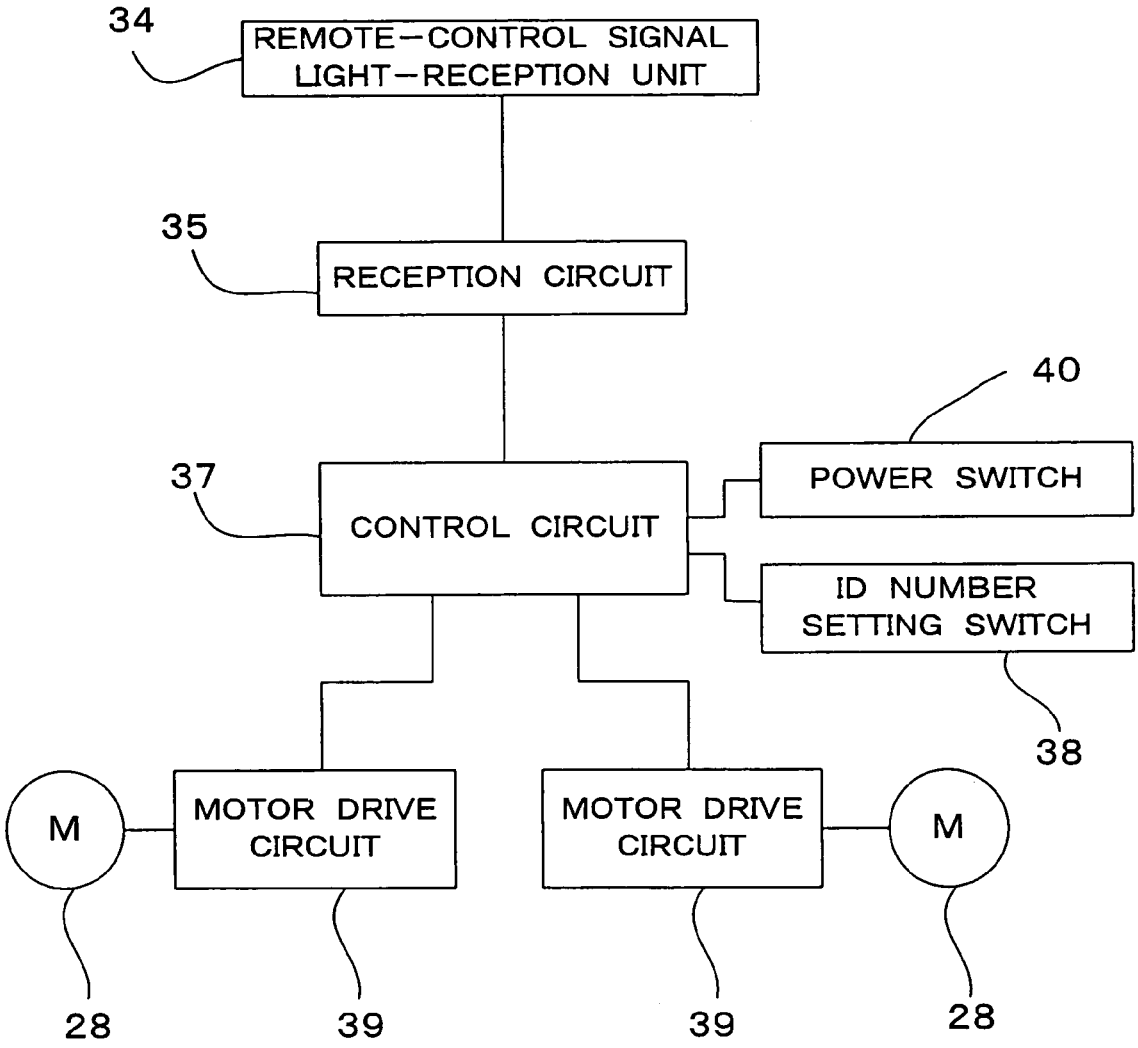
FIG. 9 shows a circuit configuration of a control system mounted on a drive device of FIG. 1.

FIG. 9 shows the circuit configuration of a control system mounted on the drive device 1. A remote-control signal light-reception unit 34 provided in the drive device 1 receives the infrared or the like transmitted from the transmitter 2 and outputs the signals, in which the carrier component is removed from the received infrared or the like, to a reception circuit 35. The reception circuit 35 decodes the signals given from the remote-control signal light-reception unit 34 into the drive data of one block to output the drive data to a control circuit 37. The drive data of one block is as shown in FIG. 8. The control circuit 37 judges the identification number of the reception data given from the reception circuit 35. The control circuit 37 compares the identification number with the identification number set by the identification number setting switch 38 to judge whether the data is valid or invalid. That is, when the identification numbers are different from each other, the control circuit 37 judges that the drive data is invalid and the control circuit 37 does not generate the drive signals for the motor in the drive device 1. On the contrary, when the identification numbers are identical to each other, the control circuit 37 determines a rotational direction and rotational speed of the motor in the drive device 1 based on motor control information of the drive data given from the reception circuit 35, and the control circuit 37 outputs the motor drive signals corresponding to the determined value to motor drive circuits 39 and 39. Each motor drive circuit 39 controls the rotation of the motor in the drive device 1 based on the given motor drive signals. Note that an identification number setting switch 38 can be configured to select an arbitrary identification number from a predetermined range determined by the operator or the system manager, or to fix previously to the specified number by the manufacturer of the transmitter 2. A power switch 40 is also connected to the control circuit 37.

In the remote-control system of this embodiment, while each transmitter 2 receives remote-control signals transmitted from another transmitter 2, each transmitter 2 specifies the timing to transmit the remote-control signal. As a result, each transmitter 2 provides synchronization of the transmission timing not to overlap the transmission timing of each transmitter 2 with each other. This point will be described below.

Figure 10:
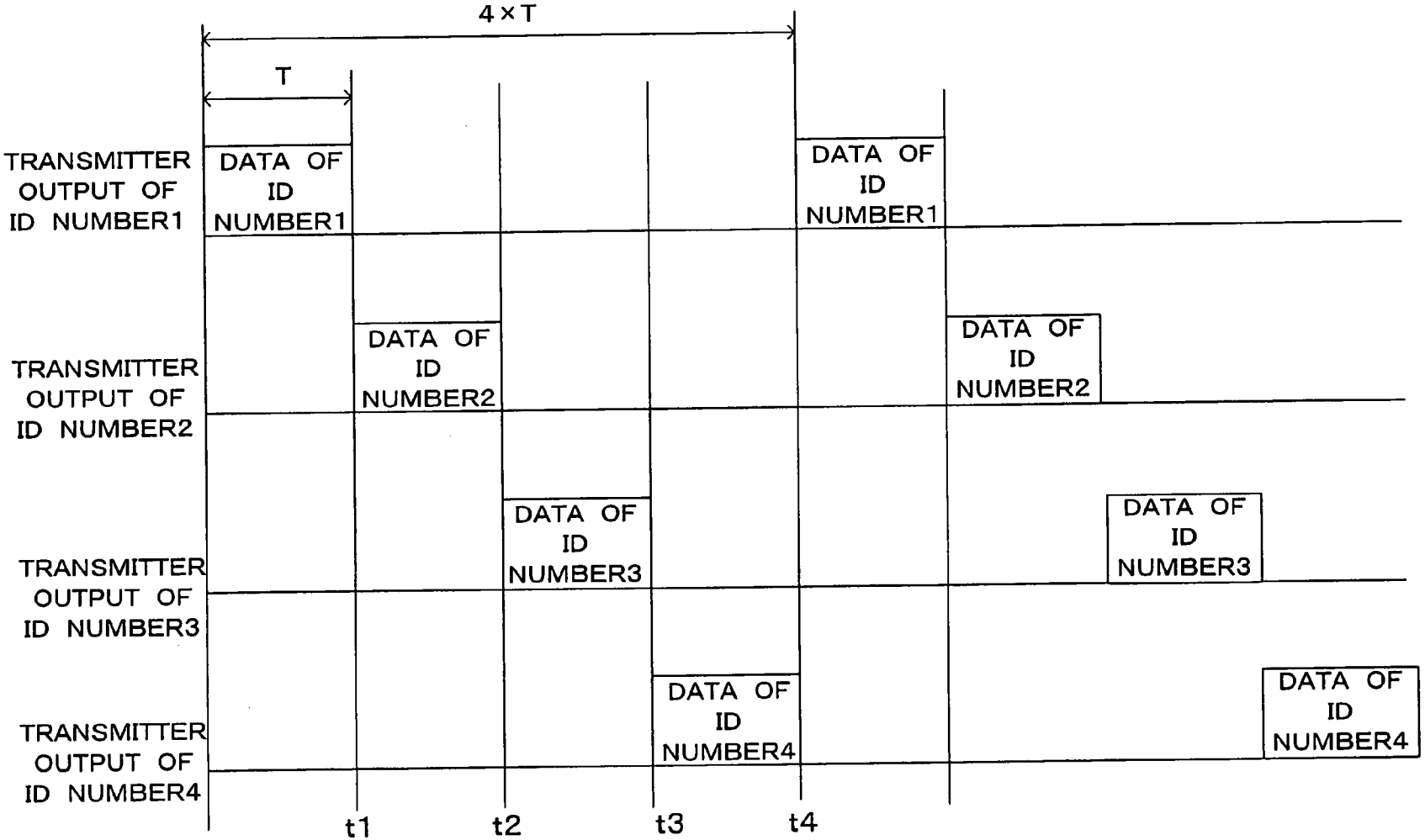
FIG. 10 shows how to manage transmission timings when four transmitters are simultaneously used.

FIG. 10 shows the transmission timing which is provided when four transmitters 2 are simultaneously used. In FIG. 10, a time interval when one transmitter 2 transmits the remote-control signal is T, and each transmitter 2 repeatedly transmits the remote-control signal in a period corresponding to the number of transmitters 2×transmission time interval T (=4T). The transmission timing of each transmitter 2 is sequentially shifted from one another by T from the identification number 1. Each transmitter 2 manages the transmission timing according to the above-described relationship. This allows the transmission time intervals of the four transmitters 2 not to overlap one another. In order to realize this transmission control, for example, for the transmitter 2 having the identification number 2 of FIG. 10, the transmission timing may be controlled as follows:

When the transmitter 2 having the identification number 2 receives the data of the identification number 1 at a time t1, the transmitter 2 having the identification number 2 starts to output the transmit data of itself and finishes the output of the own transmit data at a time t2. When the transmitter 2 having the identification number 2 finishes the transmission, the transmitter 2 having the identification number 2 checks the reception data of the reception circuit 16 (see FIG. 7) to confirm that the interference of the signals does not occur. Then, the transmitter 2 having the identification number 2 sets a transmit timer for counting the next output timing after 3T and starts the timer count.

Then, when the power of the transmitter 2 having the identification number 1 is turned off, or when the transmitter 2 having the identification number 2 can not receive the data from the transmitter 2 having the identification number 1 due to noise or the like, the transmitter 2 having the identification number 2 can start to output the own data at the time when the count of the transmit timer proceeds by time T after the reception of the data of the identification number 4. Further, even if the transmitter 2 having the identification number 2 can not receive the signals from other transmitters 2, the transmitter 2 having the identification number 2 can continue the output of the transmit data in the period 4T by utilizing the time 3T which is set to the transmit timer in finishing the transmission of the own data.

Although the case of the four transmitters 2 was described in this case, similarly the transmission timing can be controlled even in the case of five and more transmitters 2 by adding the identification number. The period of the transmission timing of each transmitter 2 becomes N×T (N is the number of transmitters) However, it is possible that a blank interval in which any transmitter does not transmit the data is inserted into between the intervals in which each transmitter 2 transmits the data, thereby the whole period may be set longer than NT.

Figure 11:
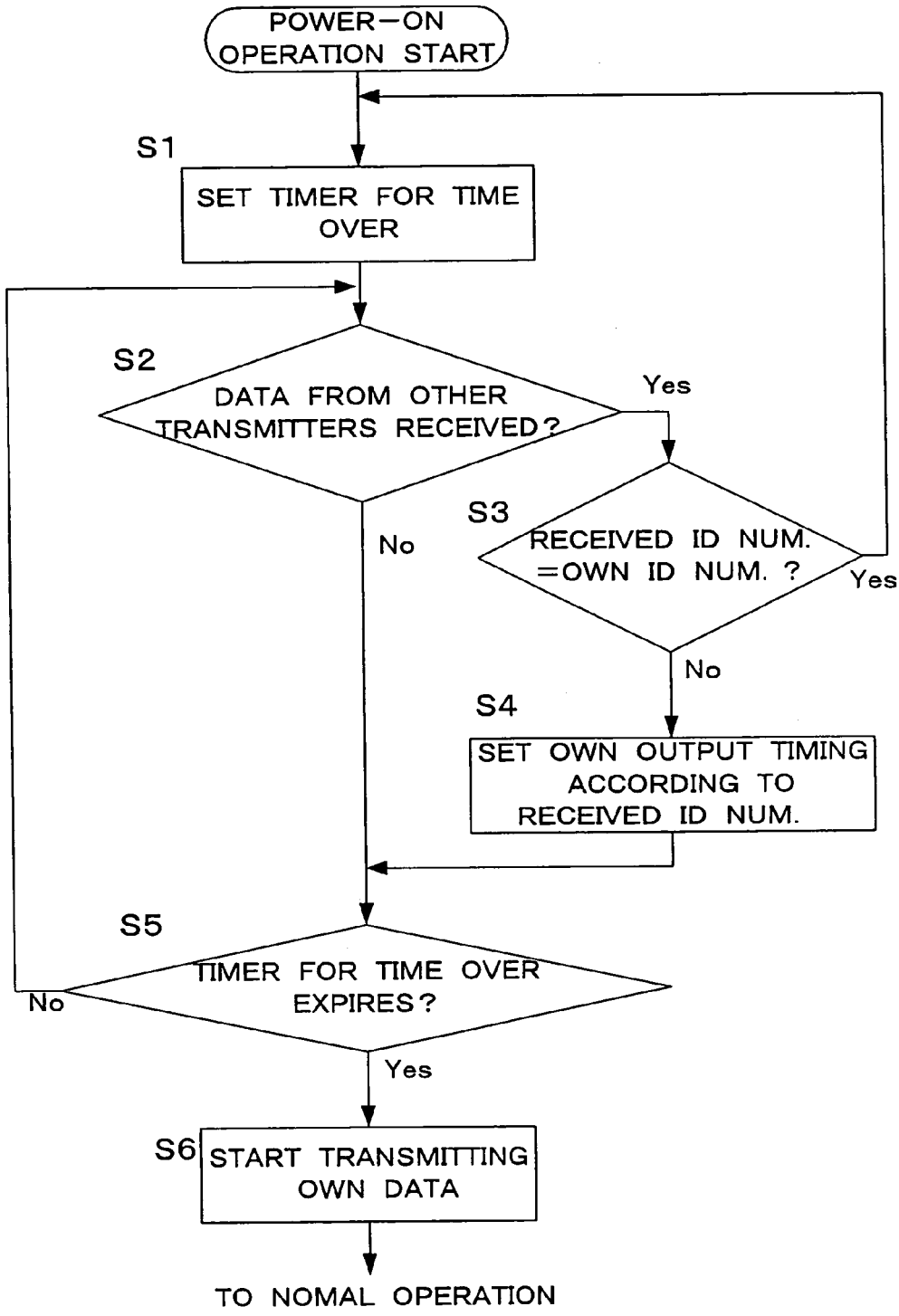
FIG. 11 is a flow chart showing the procedure from power-on to start of transmission of own data, which is executed by the control circuit in the transmitter of FIG. 1.

FIG. 11 is a flow chart showing the procedure of a power-on operation executed by the control circuit 10 in the transmitter 2 from turning the power on to the start of the transmission of the own data. When the power is turned on, the timer for time over is first set (Step S1). Then, the control circuit 10 judges whether the data from other transmitters 2 has been received (Step S2). When the data from other transmitters 2 has been received, the control circuit judges whether the identification number of the received data is identical to the identification number set to the paired transmitter 2 (Step S3). When the identification number of the received data is identical to the identification number set to the transmitter 2 of itself, the procedure returns to Step S1 to repeat the judgment operation. Accordingly, the interference is prevented in the case where there are plural transmitters 2 having the same identification numbers. When the identification number of the received data is not identical to the identification number set to the transmitter 2 of itself in Step 3, the control circuit 10 sets the own output timing according to the identification numbers of other transmitters 2 (Step S4). For example, when the transmitter 2 having the identification number 2 of FIG. 6 receives the data of the identification number 3, the transmitter 2 having the identification number 2 sets the own output timing to come after 2T time intervals.

Then, the control circuit 10 judges whether the timer set in Step S1 expires (Step S5). When the timer does not expire, the procedure returns to Step S2. When the timer expires, the transmitter 2 of the identification number 2 starts to transmit the own data (Step S6). However, the transmitter 2 of the identification number 2 actually starts to output the own data at the timing set in Step S4 comes. When the transmitter 2 having the identification number 2 does not received the data until the timer expires, it is the case of single operation, i.e. there is no other transmitters 2, so that the control circuit 10 immediately starts the data transmission in Step S6.

Figure 12:
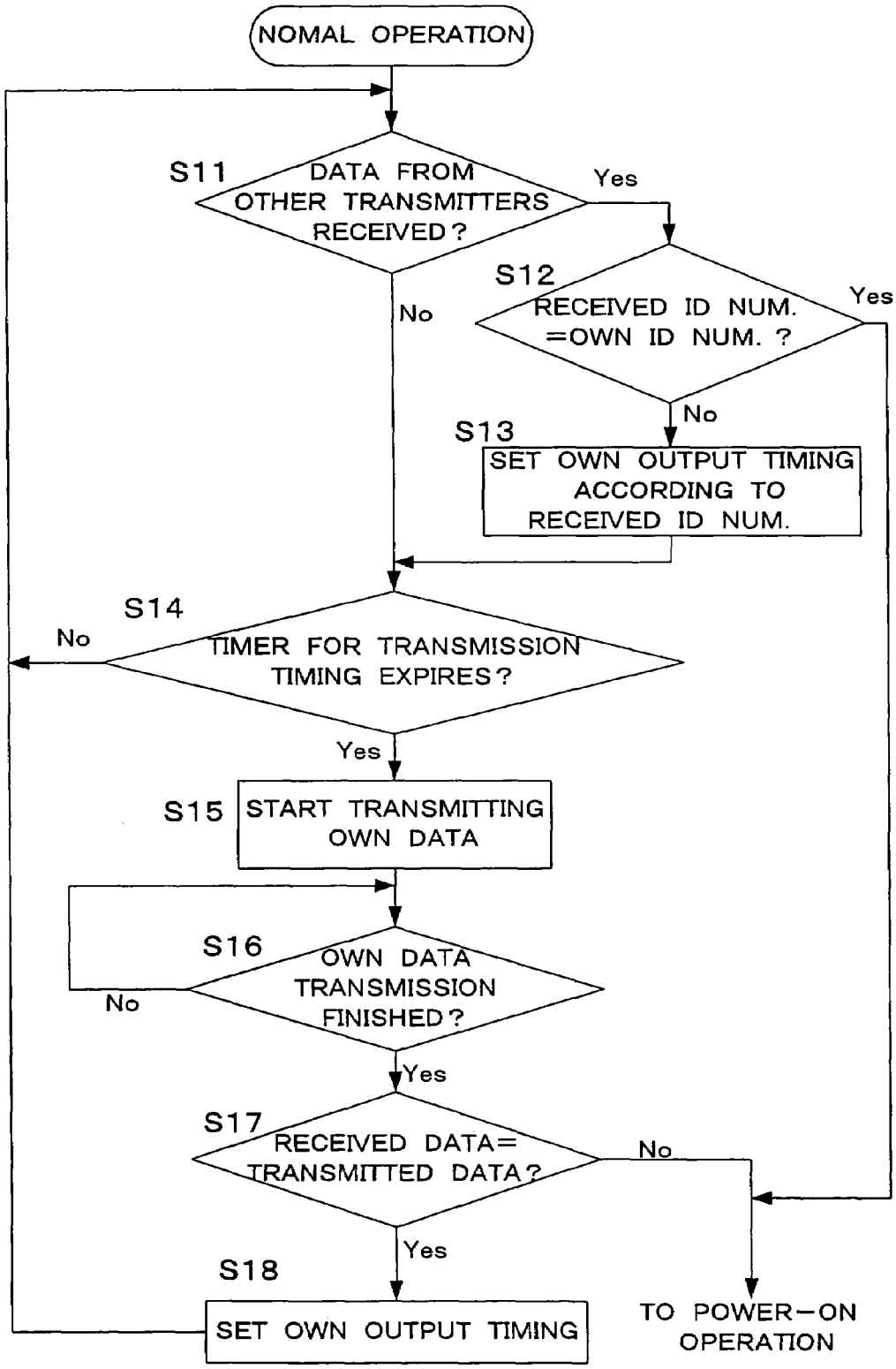
FIG. 12 is a flow chart showing the procedure of a normal operation to be executed by the control circuit in the transmitter of FIG. 1.

When the process of Step S6 is finished, the control circuit 10 controls the data transmission according to the procedure of the normal operation in FIG. 12. In the normal operation, the control circuit 10 judges whether the data from other transmitters 2 is received (Step S11). When received, the control circuit 10 judges whether the identification number of the received data is identical to the identification number set in itself (Step S12). When identical, the procedure returns the power-on operation of FIG. 11. When the identification number of the received data is not identical to the identification number set in itself, the control circuit 10 sets the output timing of itself to the transmit timer according to the identification number of the received data (Step S13). Then, the control circuit 10 judges whether the transmit timer expires (Step S14). The procedure returns to Step S1 until the transmit timer expires.

When the control circuit 10 judges that the transmit timer expires in Step S4, the transmitter 2 of the identification number 2 starts to transmit the own data (Step S15). At this moment, the transmitter 2 of the identification number 2 simultaneously receives the data. Then, the control circuit 10 judges whether the data transmission is finished (Step S16). When the data transmission is finished, the control circuit 10 compares the transmitted data with the simultaneously received data (Step S17). When the transmitted data is not identical to the simultaneously received data, it is judged that the interference occurs, then, the procedure goes back to the power-on operation of FIG. 7. When the transmitted data is identical to the simultaneously received data, it is judged that there is no interference, so that the control circuit 10 sets the next output timing to the transmit timer (Step S18). After that, the procedure returns to Step S1.

The remote-control system in the present invention is not limited to the above-described embodiment, and can be executed in various modes. For example, the drive device is not limited to the automobile, and the drive device may be the object which mimics various moving bodies such as a tank, a hovercraft, and a submarine. The transmitter may be a hand-held type or a stationary type. A particular program is installed in a portable device such as a portable game machine or a mobile phone to function the portable device as the transmitter.

FIG. 2A shows an example of the configuration of the play facility in the present invention. The play facility 67 has an almost rectangular-solid chassis 50. The circuit course 66 is provided as the play field on the upper surface of the chassis 50 and the stations 56 . . . 56 are provided on the side face of the chassis 50 so that the players can look over the circuit course 66. The circuit course 51 in the circuit field 66 is configured to be a road course including one control line 57 which is of a start point and a finish point and three corner points 53 . . . 53. The shape of the circuit course 51 is formed by a course wall 52*a* and a peripheral wall 52*b* provided on peripheries on the upper surface of the chassis 50. Each of sensors for reading a reed switch 120 mounted on the drive device 1 is individually installed in each of the corner points 53 . . . 53 and the control line 57 in the circuit course 51.

The reed switch 120 means the device which transmits the identification information which each drive device 1 has, and the reed switch 120 may be a barcode or the like as long as the drive device 1 participating the race can be specified. Further, the reed switch may be built in the drive device 1 or may be attached to the outside of the body.

The sensors installed in the circuit course read the reed switch 120 mounted on the drive device 1 to specify the drive device 1, when the drive device 1 passes through necessary passage areas 54 . . . 54 and 57 in the course. The necessary areas 54 . . . 54, and 57 mean the area where the drive device 1 must pass through in the race.

In this embodiment, the form of the circuit course 51 is not limited to this embodiment, such as an oval course, a street course, or the like. Some sensors for reading the reed switch may be added in addition to the sensors installed in the corner points 53 . . . 53 and the control line 57.

The player performs the remote control with the transmitter 2 at the stations 56 . . . 56. Station numbers 1 to 4 are numbered to the stations 56 . . . 56, and the stations 56 . . . 56 are horizontally arranged along the side face located on the front face of the chassis 50. The station numbers 1 to 4 correspond to the identification numbers 1 to 4 of the remote-control system in this embodiment respectively. That is, when the remote-control system of the identification number 1 is operated, the player operates the remote-control at the station of which the station number is 1. With respect to the installation place of the stations 56, the stations 56 . . . 56 are integrated with the chassis 50 in this embodiment. However, the installation place of the stations 56 is not limited to this embodiment. It is possible that the stations 56 . . . 56 are separated from the chassis 50, or it is possible that the stations 56 . . . 56 are arranged so as to surround the circuit field 66. The installation number of stations 56 can be properly changed up to the number in which the transmitters can be simultaneously used in the same play facility according to identification information of the remote-control system to which the invention is applied.

Figure 2B:
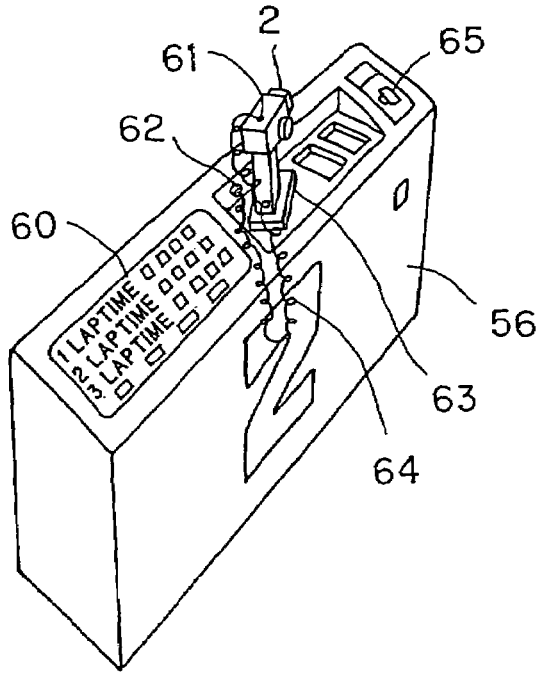
FIG. 2B is an expanded view of a station portion in the play facility.

FIG. 2B shows an expanded view of the station 56. A panel screen 60, a drive data input unit 62, a transmitter installation unit 63, and a coin input unit 65 are provided in each station. One end of a code 64 is connected to the drive data input unit 62. The transmitter output unit 61 in the transmitter 2 of the player is connected to one end which is not connected to the station 56. This is because the drive data output from the transmitter 2 is sent to the circuit field 67 through the drive data input unit 62.

The boosters 55 . . . 55 whose output ports are orientated toward the circuit course 51 are provided at several places of the circuit course 51. The scramble signals or the drive data output from the transmitter 2 is output from the boosters 55 . . . 55. The scramble signal means the signal to interfere with the remote control of the drive device 1 with the transmitter 2. While the boosters 55 . . . 55 are provided at four corners of the circuit course 51 in this embodiment, the installation place and the installation number of boosters 55 . . . 55 may be arranged so that the signal and the data output from the booster 55 reach the whole of the circuit field 66 including all the stations, and the installation place and the installation number of boosters 55 . . . 55 can be properly changed according to a size of the circuit course 51 or intensity of the output from the boosters 55 . . . 55.

The circuit field 66 also includes a notice board 58 for displaying race information and speakers 59, 59 for performing sound effect. The notice board 58 and the speakers 59 and 59 are orientated toward the side of the stations 56 . . . 56.

The configuration of a control system circuit provided in the play facility 67 and the flow of the signal or the data in each control will be described below.

Figure 3:
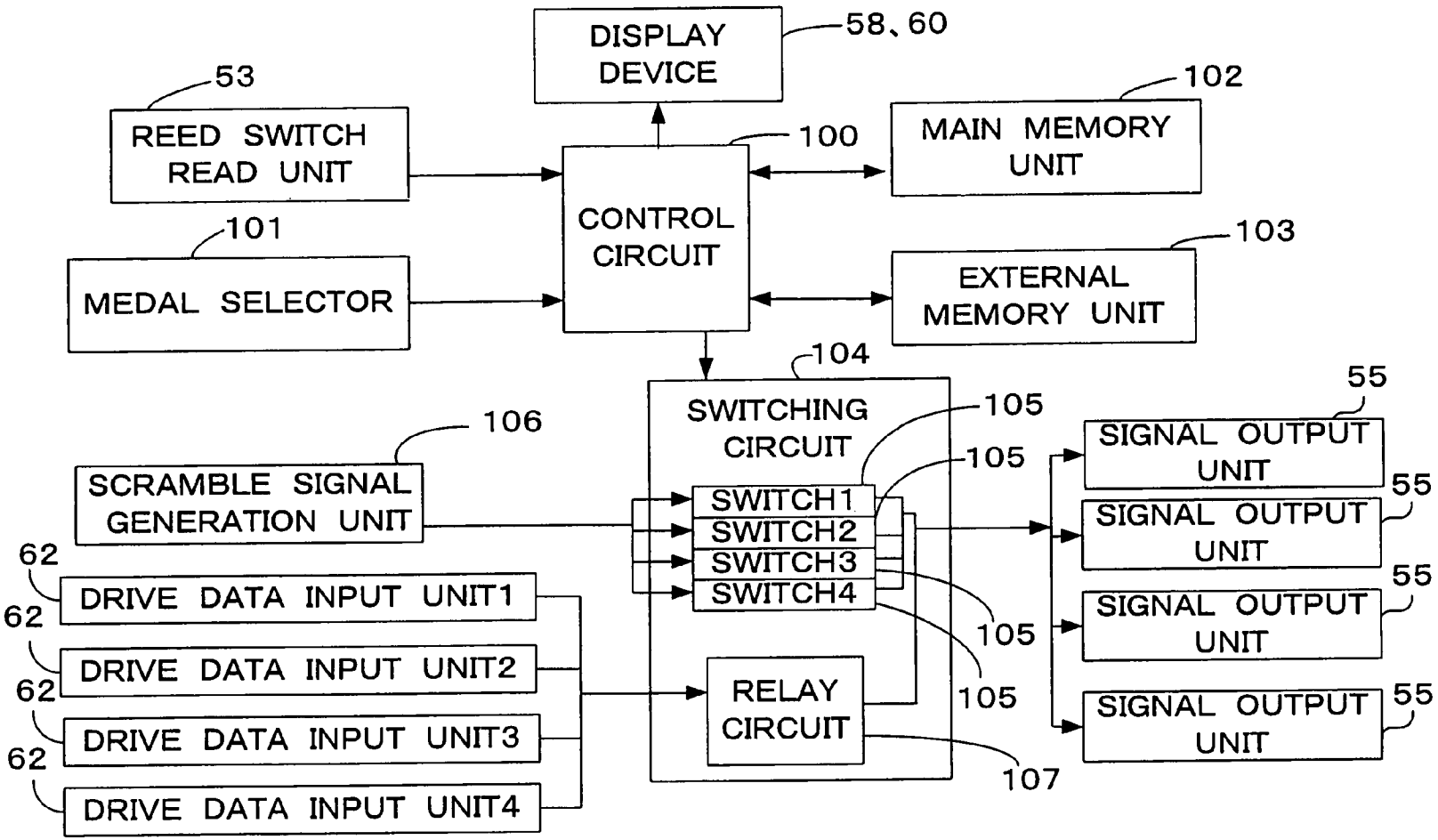
FIG. 3 shows an example of the configuration of a control circuit included in the play facility in the present invention.

FIG. 3 shows an example of the configuration of a control circuit 100 included in the play facility 67. The play facility 67 includes the control circuit 100 which controls the data dealt with by the play facility 67. The control circuit 100 is connected to a medal selector 101, a reed switch read unit 53, display devices 58 and 60, a main memory unit 102, an external memory unit 103, and a switching circuit 104. The switching circuit 104 is connected to a scramble signal generation unit 106, the drive data input units 62 . . . 62, a relay circuit 107, and the signal output units 55 in addition to the control circuit 100. Switches 105 . . . 105 for changing output modes from the signal output units 55 are provided in the switching circuit 104. The drive data input units 62 . . . 62 and the switches 105 . . . 105 respectively correspond one-to-one with the identification number of the remote-control system in this embodiment.

In the play facility 67, the mode of the switch 105 is set to the output mode of the scramble signals until the remote control is permitted, and the scramble signals are output from the signal output unit 55. Therefore, the drive device 1 can not be remote-controlled with the transmitter 2 in the play facility 67.

The medal selector 101 outputs the data concerning the dropped medal to the control circuit 100. For example, the identification number of the station 56 in which the predetermined amout of medals is dropped is output as the identification number in which the remote control should be permitted. The control circuit 100 directs the switching circuit 104 to switch to the output signal corresponding to the identification number to which remote control is permitted. In the switching circuit 104, according to the direction, the switch 105 corresponding to the identification number seitches from the output mode of the scramble signal to the termination mode. The drive data corresponding to the identification number, which is input from the drive data input unit 62, is relayed to the signal output units 55 . . . 55 through the relay circuit 107. In the relay circuit 107, it is also possible to amplify the relayed drive data. Therefore, instead of the scramble signals, the drive data to mean the remote control is permitted is output from the signal output units 55 . . . 55. Then, for example after a predetermined time has elapsed, when the direction of prohibiting the remote control corresponding to the identification number is provided from the control circuit 100 to the switching circuit 104, the relay circuit 107 terminates the relay of the drive data corresponding to the identification number. The switch 105 is changed to the scramble signal output mode, and the switch 105 outputs the scramble signal corresponding to the identification number to the signal output units 55 . . . 55. Consequently, the remote control can not be performed with the identification number.

The drive data input unit 62 transmits the drive data to the switching circuit 104 in order to output the drive data output from the transmitter 2 onto the circuit course 51 according to the control by the control circuit 100.

The scramble signal is generated in this scramble signal generation unit 106. The scramble signal in this embodiment has the same data structure as the drive data shown in FIG. 8, the identification number is the identification number of the transmitter 2 which is the subject of the interference of the remote control, and the control information represents information to be uncontrollable. With respect to the control information which makes the drive device 1 uncontrollable, for example, it is thought that speed information included in the control information is set to zero, and the value in excess of a predetermined maximum speed is set as the maximum speed, or the like. As shown in FIG. 11, when the transmitter 2 receives the own identification number after turning the power on, the transmitter 2 suspends the transmission of the own drive data, so that the generated signal becomes the signal which prevents the transmission of the drive data from the transmitter 2.

As described above, it is possible that the installation number of drive data input units 62 . . . 62 and the installation number of switches 105 . . . 105 are provided corresponding one-to-one with the identification numbers of the remote-control system. The installation number of drive data input units 62 . . . 62 and the installation number of switches 105 . . . 105 can be properly changed according to the remote-control system to which the invention is applied. While the four signal output units 55 . . . 55 are provided, as described above, the number of signal output units 55 can be properly changed depending on the intensity of the output of the boosters 55 . . . 55 or the size of the circuit course 51. For example, when the control circuit 100 has the function of amplifying the drive data output from the transmitter 2, the installation number of boosters can be reduced without changing the intensity of the output from the transmitter 2.

In this embodiment, the drive data output from the transmitter 2 is output from the signal output units 55 . . . 55 according to the control of the control circuit 100, but the invention is not limited to this embodiment. When the output from the transmitter 2 is sufficiently strong, it is possible that only the scramble signal is output from the signal output unit 55 and the switching circuit 104 has only the function of switching whether the scramble signal is output. It is also possible to provide only the relay circuit 107 without utilizing the scramble signal in this embodiment, and whether the input drive data is relayed to the signal output unit 55 may correspond to the control whether the remote control is permitted.

In this embodiment, the condition for terminating the output of the scramble signal is that the predetermined amount of medals is dropped. However, the invention is not limited to the embodiment. For example, other conditions can be also set such that the permission of the remote control is given to only a player having the excellent result. Further, according to the amout of the dropped medals, it is also possible to set the time when the player can use the circuit course 51.

The reed switch read unit 53 reads the data of the reed switch mounted on the drive device 1 through the sensors installed in the corners 53 . . . 53 and control line 57 of the circuit course 51. On the basis of the data, the control circuit 100 can grasp when the drive device 1 passes through which point or what number the drive device 1 is running, and the control circuit 100 performs race management in conjunction with the main memory device. The race management means the management concerning the race such as timing of a rap time, determination of a race rank, record of a race result, payment of penalty for the case in which the drive device 1 does not pass through the necessary passage area.

The result history of the player is stored in the external memory device 103, and the control circuit 100 can read the result history of the player from the external memory device 103 to reflect the result history to the race result or switch control of the switches 105 . . . 105 in the switching circuit 104. The control circuit 100 properly outputs to the display device 58, 60 contents, which should be notified to customers and players, such as directions of the operation to players and a race status.

Further, it is possible that a medal refund unit is connected to the control circuit 100. This allows the refund of the medal to be performed to the higher-ranking players of the race according to the result of the game. Adjustment of the amount of refund can enhance player's interest and always secure profits for the side to install the play facility 67.

It is also possible that the control circuit 100 and the switching circuit 104 are configured as the logic circuit, or it is also possible that the control circuit 100 and the switching circuit 104 are configured by combination with middleware and software.

Figure 4:
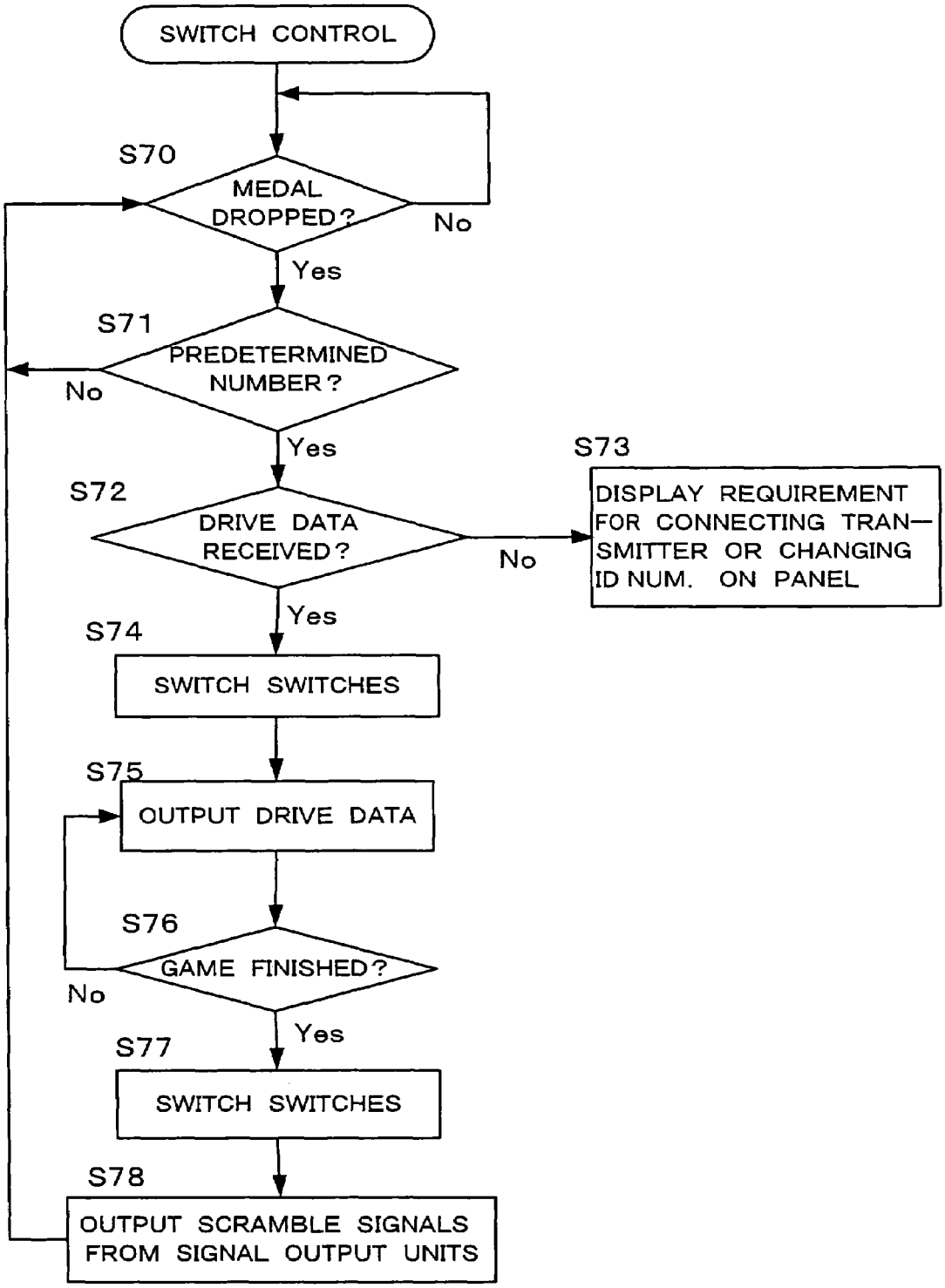
FIG. 4 shows a procedure of switch control which is executed by the control circuit included in the play facility in the present invention.

FIG. 4 is the flow chart showing the procedure of the switch control executed by the control circuit 100 included in the play facility. In Step S70, the control circuit 100 judges whether the medal has been dropped. When the control circuit 100 judges that the medal has been dropped, the procedure proceeds to Step S71, and the control circuit 100 judges whether the number of medals is a predetermined number of medals. When the control circuit 100 dose not judge that the medal has been dropped, the control circuit 100 waits until the medal is dropped. In Step 71, when the control circuit 100 judges that the number of dropped medals is a predetermined number of medals, the procedure proceeds to Step S72. When the number of dropped medals is not a predetermined number of medals, the procedure returns Step S70 to wait for the medal to be dropped.

In Step S72, the control circuit 100 judges whether the drive data output from the transmitter is input. When the control circuit 100 does not confirm that the drive data is input, since there is a possibility that the transmitter is not connected to the code or the identification number is already used in the play, the notification is displayed on the panel 60 of the station in Step S73. When the control circuit 100 judges that the drive data is input in Step S72, the procedure proceeds to Step S74 to switch the switches 105 . . . 105 corresponding to the identification number to the drive data output mode. Then, in Step S75, the drive data is output from the signal output unit 55 and the player can start the game concerning the remote-control system.

In Step S76, the control circuit 100 judges whether the game finishes until the control circuit 100 judges that the game finishes. When the control circuit 100 judges that the game finishes, the procedure proceeds to Step S77. In Step S77, the switches 105 . . . 105 corresponding to the identification number is switched from the drive data output to the scramble signal output, and the procedure proceeds to Step S78. In Step S78, the control circuit 100 causes the signal output unit 55 to output the scramble signals, after that the procedure returns to Step S70 to become a medal dropping standby state.

Figure 5:
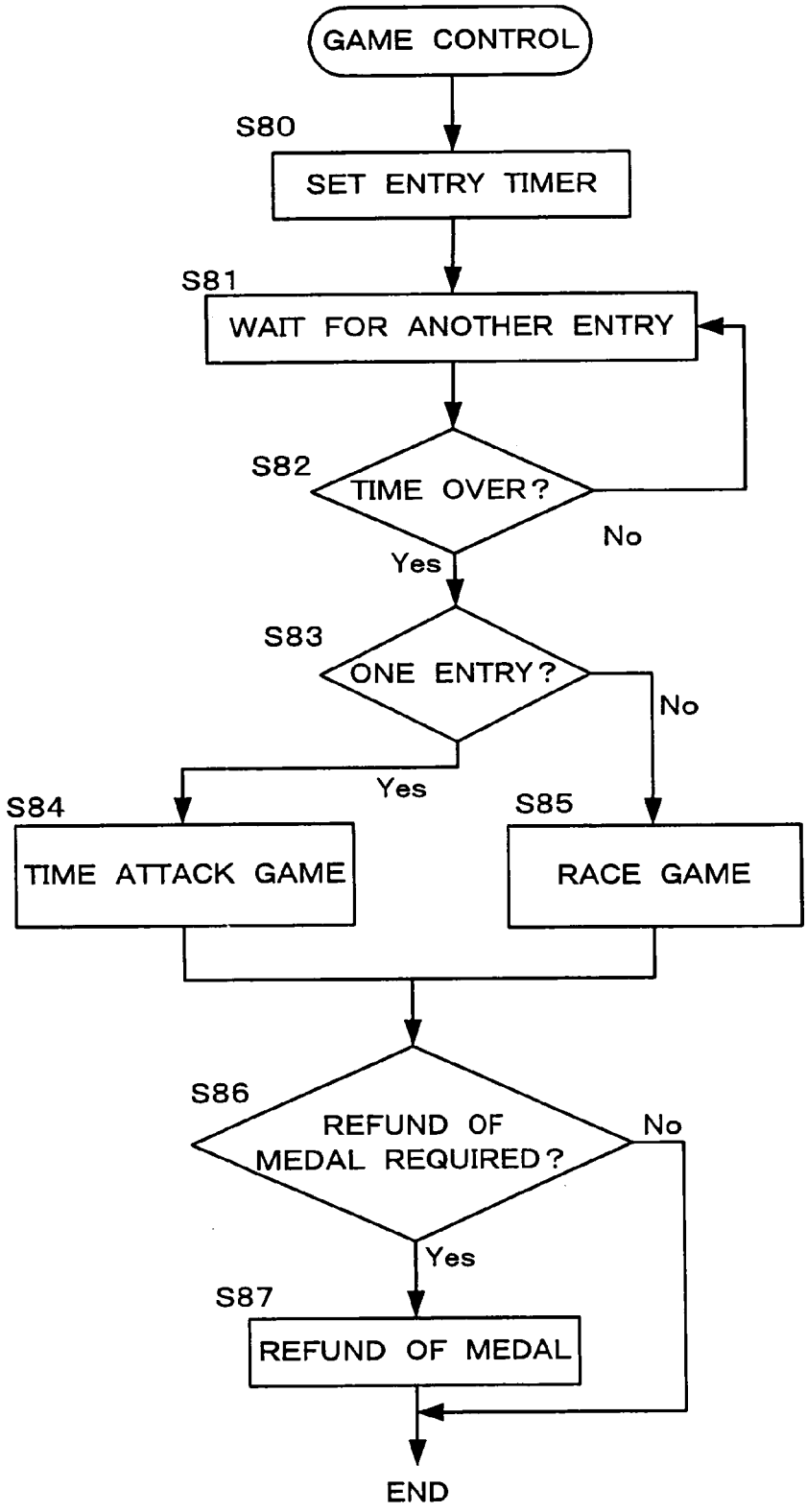
FIG. 5 shows a procedure of game control which is executed by the control circuit included in the play facility in the present invention.

FIG. 5 is the flow chart showing the procedure of the game control executed by the control circuit 100 included in the play facility 67. When one player makes an entry into the game, an entry timer is set in Step S80. The control circuit 100 repeats Step S81 and Step S82 until the entry timer expires to wait for another player's entry. In Step S83, the control circuit 100 judges whether one player makes the entry into the game. When the control circuit 100 judges that one player makes the entry into the game, the procedure proceeds to Step S84 to perform time attack control. When the control circuit 100 judges that at least two players make the entry into the game, the procedure proceeds to Step S85 to perform race control. The time attack is the game for competing about rap time when the drive device 1 runs on the course unlike the game where the plurality of drive devices 1 run on the course at the same time. When each game finishes, the control circuit 100 judges whether the refund of the medal is required in Step S86. When the control circuit 100 judges that the refund of the medal is required, the procedure proceeds to Step S87. After the refund of the medal is performed in Step 88, the game is finished. When the control circuit 100 judges that the refund of the medal is not required in step 86, the game is directly finished.

In this embodiment, the four drive devices 1 can make the entry into one race at the maximum corresponding to the four types of the identification information of the remote-control system. However, the number of drive devices 1 which can make the entry into the race can be properly changed depending on the remote-control system to which the invention is applied.

It is also possible that the player can select the race type game or the time attack type game at the moment of his/her entry without the entry time.

In the race control, qualifying races are performed before a final race, and a pole position (start grid) in the final game may be determined depending on the result of the qualifying game. The play facility 67 can be also configured to be the field where the drive devices freely run without taking place games for competing a rap time or a running rank.

The embodiment of the invention is not limited to the described above. The play facility can be realized in various designs, such as a battle field when the drive device 1 is a tank of as a filed utilizing water when the drive device 1 is a hovercraft or a submarine.

While the drive device 1 is controlled with the infrared in this embodiment, the similar play facility can be configured in the case where the drive device 1 is controlled with the radio wave. For example, in the case of the remote-control system in which the plurality of drive devices 1 can be simultaneously controlled by dividing the frequency into plural bands, by outputting the interference radio wave for each band, the control for the use of the play facility can be available in the same manner as this embodiment. Further, both the control using infrared and the control using radio wave can be performed at the same time.

As described above, according to the invention, the play facility can be installed, in which the personal use remote-control toy can be operated in large-scale facilities away from day-to-day life and the acquired play skills can be exhibited on the commercial facility, and further, by which profits can be expected also on the side to provide the facility.

The invention claimed is:

1. A play facility for a remote-control system to provide a play field for the remote-control system including a transmitter and a drive device remote-controlled by drive data transmitted from the transmitter, the play facility comprising:

a scramble signal generating device which generates scramble signals which interfere with the remote control of the drive device by the transmitter;

a scramble signal outputting device which outputs the scramble signals to the play field; and a scramble signal control device which switches between output and termination of the scramble signals from the scramble signal outputting device according to predetermined conditions; wherein the scramble signal control device allows the scramble signal outputting device to output the scramble signals until determining that the predetermined conditions are satisfied, and, when determining that the predetermined conditions are satisfied, terminates the output of the scramble signals.

2. The play facility according to claim 1, further comprising:

a drive data relay device which inputs the drive data output from the transmitter, outputs the drive data toward the play field when determining that the predetermined condition is satisfied.

3. The play facility according to claim 2, wherein the scramble signal control device has an output switching device which selectively switches between relay of the drive data by the drive data relay device and output of the scramble signal toward the play field according to the predetermined conditions.

4. The play facility according to claim 1, wherein the scramble signal control device terminates the output of the scramble signals within a range according to a dropped value.

5. The play facility according to claim 1, wherein the remote-control system has a plurality of drive devices, and each drive device is remote-controlled individually by each of a plurality of transmitters, each corresponding to each of the drive devices, the drive data transmitted by each of the plurality of transmitters includes identification information, which is unique to each transmitter for identifying the transmitter, and control information for controlling the drive device, and each of the plurality of drive devices compares the identification information included in the received drive data with identification information allocated to the drive device to determine whether the received drive data is the drive data transmitted to the drive device, and performs an operation control based on the drive data when the received drive data is the drive data transmitted to the drive device.

6. The play facility according to claim 5, wherein the scramble signal generating device generates the scramble signals for interfering with the remote control by the transmitter to which particular identification information is allocated.

7. The play facility according to claim 5, wherein each of the plurality of transmitters comprises:

a device which receives the drive data transmitted from other transmitters;

a transmission timing device which sets transmission timing of the drive data of the transmission timing device based on the identification information included in the received drive data, and transmits the drive data according to the set transmission timing; and a suspending device which determines whether the identification information included in the drive data transmitted from other transmitters is identical to the identification information set in the transmitter, and suspends the setting of the transmission timing by the timing setting device until the drive data including the identification information different from the identification information in the suspending device is received, when the identification information included in the drive data transmitted from other transmitters is identical to the identification information set in the transmitter, wherein the scramble signals includes the identification information.

8. The play facility according to claim 5, wherein, when a predetermined race take places with the plurality of drive devices in the play field, the drive device has a transmission source which transmits the identification information allocated to the driving device, the play field has at least one reception terminal to receive contents of the transmission at least at one predetermined place, and the remote-control system has a race management device which judges whether each of the drive devices participating in the race passes through the predetermined places based on the data received by the reception terminals, and manages data concerning wins and losses of the race.

9. The play facility according to claim 8, wherein the race management device returns a refund of the value according to the result of the race.

* * * * *